US008141630B2

(12) United States Patent
Pliska

(10) Patent No.: US 8,141,630 B2
(45) Date of Patent: Mar. 27, 2012

(54) SUCKER ROD STRING

(75) Inventor: Ross Pliska, Sherwood Park (CA)

(73) Assignee: Dover Corporation (Canada) Ltd., Edmonton, Alberta (CA)

( * ) Notice: Subject to any disclaimer, the term of this patent is extended or adjusted under 35 U.S.C. 154(b) by 34 days.

(21) Appl. No.: 12/252,471

(22) Filed: Oct. 16, 2008

(65) Prior Publication Data

US 2009/0279947 A1 Nov. 12, 2009

(30) Foreign Application Priority Data

May 7, 2008 (CA) ..... 2634557

(51) Int. Cl.
*E21B 17/042* (2006.01)
*F16L 15/06* (2006.01)

(52) U.S. Cl. ..... 166/242.6; 166/105; 403/296; 403/343

(58) Field of Classification Search ..... 166/105, 166/242.6; 403/343, 296
See application file for complete search history.

(56) References Cited

U.S. PATENT DOCUMENTS

| | | | | | |
|---|---|---|---|---|---|
| 1,851,714 | A * | 3/1932 | McCullough | ..... | 403/296 |
| 2,699,154 | A | 1/1955 | Smith | | |
| 3,388,935 | A * | 6/1968 | Hjalsten et al. | ..... | 403/343 |
| 3,717,368 | A * | 2/1973 | Czarnecki et al. | ..... | 403/343 |
| 3,797,865 | A * | 3/1974 | Ballentine | ..... | 285/148.19 |
| 3,822,952 | A * | 7/1974 | Johansson et al. | ..... | 403/343 |
| 3,876,319 | A * | 4/1975 | Meyer | ..... | 403/343 |
| 4,202,420 | A * | 5/1980 | Peetz et al. | ..... | 175/395 |
| 4,295,751 | A * | 10/1981 | Holmberg | ..... | 403/306 |
| 4,570,673 | A * | 2/1986 | Kendrick et al. | ..... | 137/615 |
| 7,108,063 | B2 * | 9/2006 | Carstensen | ..... | 166/241.2 |
| 7,193,526 | B2 * | 3/2007 | Hall et al. | ..... | 340/853.7 |
| 7,654,316 | B2 * | 2/2010 | Telfer | ..... | 166/242.6 |

* cited by examiner

*Primary Examiner* — David Bagnell
*Assistant Examiner* — Catherine Loikith
(74) *Attorney, Agent, or Firm* — Davis & Bujold, P.L.L.C.

(57) ABSTRACT

An improvement in a sucker rod having an elongated metal body with opposed ends and threaded couplings positioned at each of the opposed ends comprises a thread form on the threaded couplings defining at least two concurrent helixes. Each of the at least two helixes has a different starting position on a circumference of the threaded coupling.

3 Claims, 3 Drawing Sheets

SUCKER ROD STRING

FIELD

The present invention relates to a sucker rod which forms part of a rod string connecting surface equipment with a pump positioned down a well.

BACKGROUND

A sucker rod has an elongated metal body with threaded couplings at each end. The sucker rods are connected end to end to form a rod string to operate a pump positioned down a well. When there is a failure in the rod string, it can usually be attributed a failure occurring at one of the threaded couplings. In order to avoid such failures, the threaded couplings are being made considerably stronger than the body of the sucker rods. Notwithstanding that the threaded couplings are stronger, failures of the rod string are still occurring at the threaded coupling.

SUMMARY

There is provided an improvement in a sucker rod having an elongated metal body with opposed ends and threaded couplings positioned at each of the opposed ends. The improvement includes a thread form on the threaded couplings defining at least two concurrent helixes. Each of the helixes has a different starting position on a circumference of the threaded coupling.

It is believed that premature failure of rod strings at threaded couplings between the sucker rod sections that make up the rod string can be attributed to human error. If a threaded coupling is not made up correctly, reactive torque acting upon the rod string can result in substantial torque being applied to the rod string.

BRIEF DESCRIPTION OF THE DRAWINGS

These and other features will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION

A thread form 10 for a sucker rod 12 will now be described with reference to FIG. 1 through 4.

Figure 1:
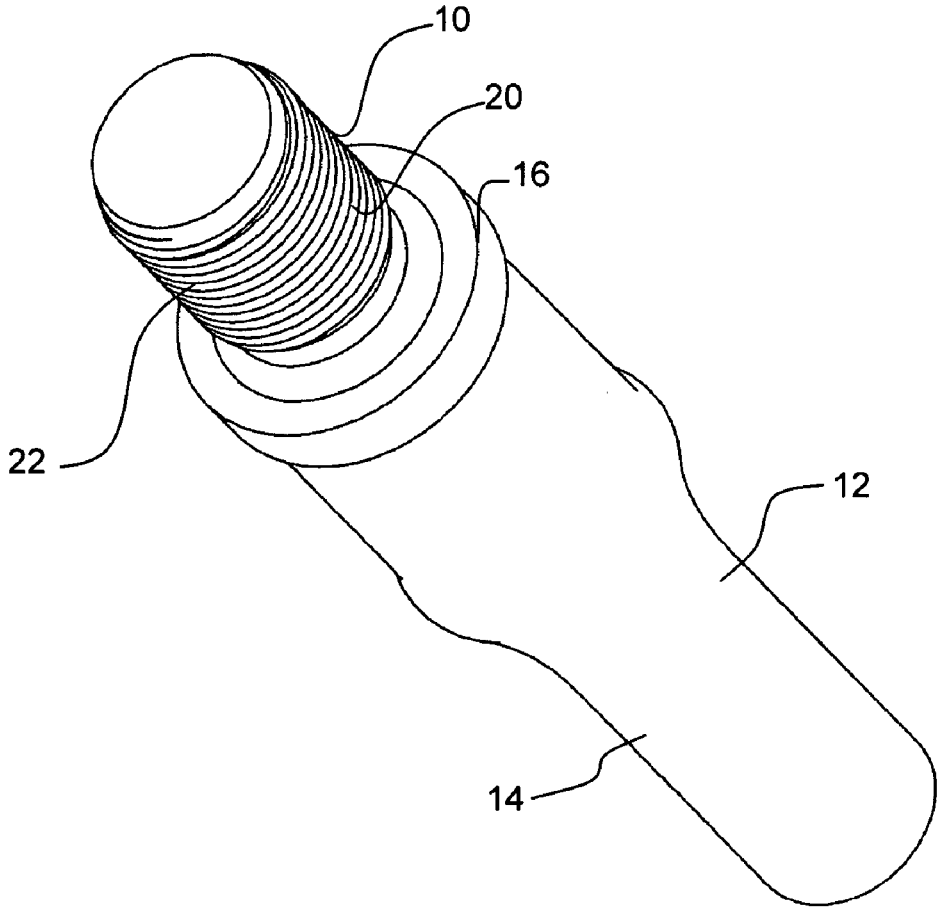
FIG. 1 is a perspective view of an improved sucker rod.
Figure 2:
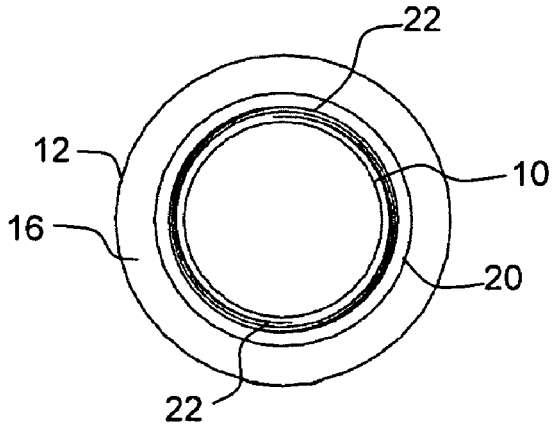
FIG. 2 is an end elevation view of an improved sucker rod.
Figure 3:
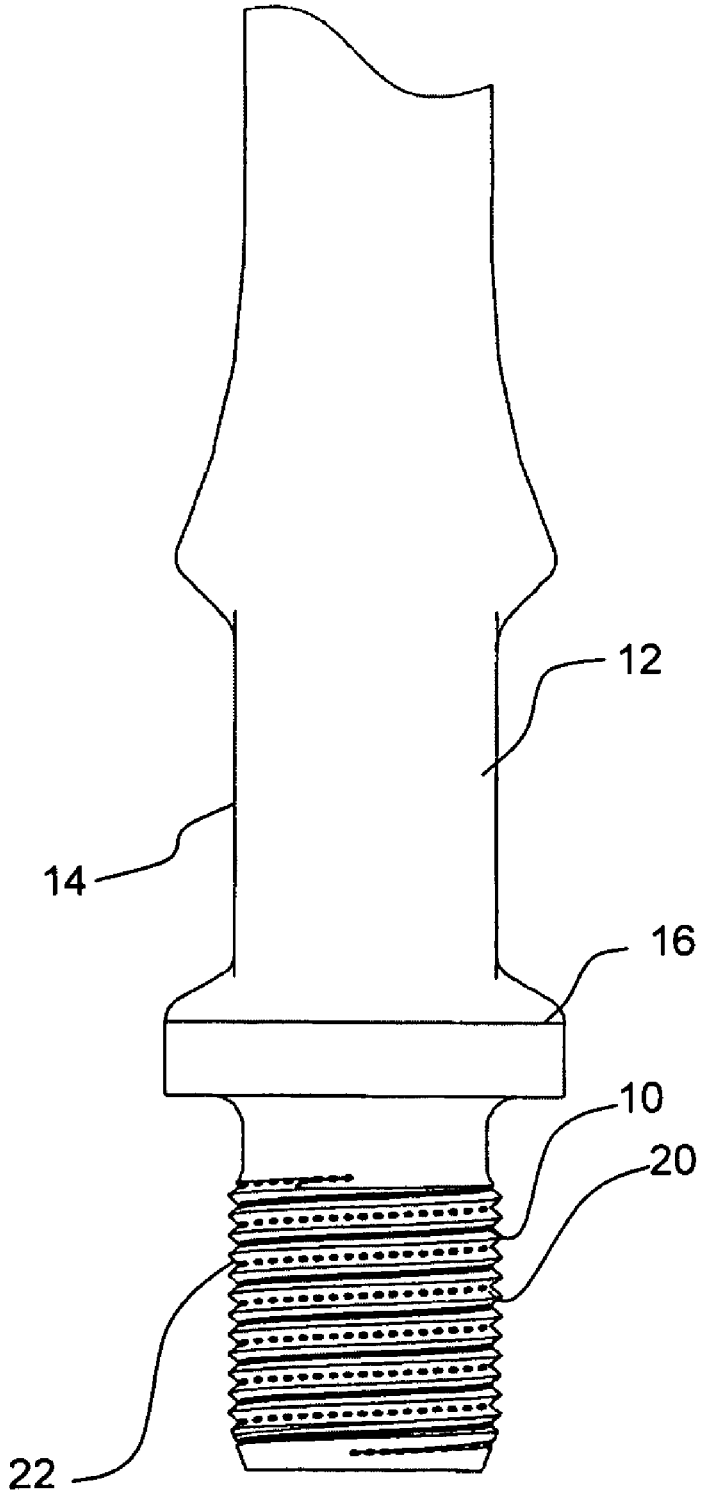
FIG. 3 is a side elevation view of an improved sucker rod.

Structure and Relationship of Parts:

Referring to FIG. 1, sucker rod 12 has an elongated metal body 14 with opposed ends 16 (only one end 16 being shown), and threaded couplings 20 positioned at each opposed end. Thread form 10 is positioned on threaded couplings 20, such as male threaded couplings as shown, female threaded couplings (not shown), or a male threaded coupling at one end and a female threaded coupling at the other. Thread form 10 defines two concurrent helixes 22. As shown in FIG. 2, each helix 22 has a different starting position on a circumference of the threaded coupling 20. While two helixes 22 have been illustrated, it will be apparent that more than two helixes 22 may be used.

When installed, thread form 10 as shown is used to mate with a corresponding female thread form (not shown) with a similar double helix design.

Advantages:

By designing couplings 20 to have two or more helixes results in a multiple-start threaded connection, better results are provided in instances where a slip event is prone to occur. A slip event generally occurs when the frictional forces induced during the connection makeup are not string enough to hold under operational torque. This is mainly due to improper makeup torque, or the presence of lubricant in connection mating surfaces. Due to its larger lead angle (the pitch of the thread as it winds about the connection) relative to a single start threaded connection, the multiple start thread connection generates less axial loads when subjected to the same torque. Given that both threads are transferring the same torque, the axial load on the multiple start thread is less than the axial load on the single start thread. For this reason, the multiple start thread has fewer tendencies to become damaged at higher torque rates, either during a slip event or otherwise. For example, in one test that was performed, it was found that, with consistent, improper makeup techniques, traditional single start connections failed in the connection about half the time, whereas the multiple start connection never failed in the connection. Furthermore, the larger lead angle also allows the multiple start threaded connection to be made up faster than the single start threaded connection.

Figure 4:
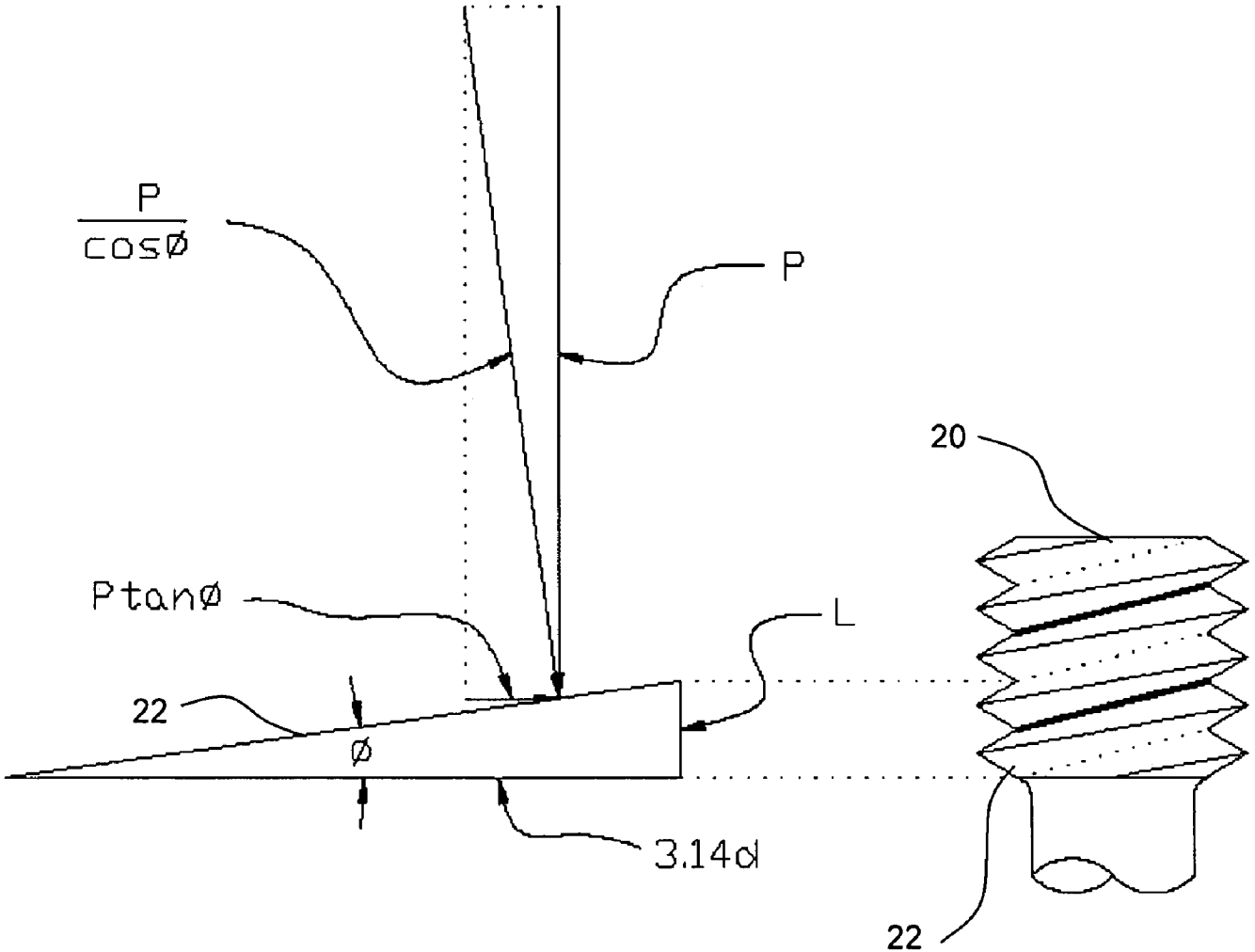
FIG. 4 is a diagram depicting the axial load generated when a torque is exerted on the connection.

Referring to FIG. 4, the advantages offered by the multiple start thread principle are illustrated by considering the equation for the component of torque that is used to develop the axial load. In the discussion below, the following nomenclature is used:

T=Torque $T_s$=Torque on single start threaded connection $T_m$=Torque on multiple start threaded connection P=Axial load $P_s$=Axial load on the single start threaded connection $P_m$=Axial load on the multiple start threaded connection L=Lead $L_s$=Lead of the single start threaded connection $L_m$=Lead of the multiple start threaded connection The equation that defines the torque component is:

$$T = \frac{PL}{2\pi} \quad \text{Eq. 1}$$

Adopt Eq. #1 for multiple start thread:

$$T_m = \frac{P_m L_m}{2\pi} \quad \text{Eq. 2}$$

Adapt Eq. #1 for single start thread:

$$T_s = \frac{P_s L_s}{2\pi} \quad \text{Eq. 3}$$

For comparison purposes the torque is equal for both types of thread:

$$T_m = T_s \quad \text{Eq. 4}$$

Substitute Eq. 2 and Eq. 3 into Eq. 4 and solve for $P_m$:

$$\frac{P_m L_m}{2\pi} = \frac{P_s L_s}{2\pi} \quad \text{Eq. 5}$$

$$P_m = \frac{P_s L_s}{L_m}$$

Given that the multiple thread coupling has a larger lead than the single thread coupling, then:

$$L_m > L_s \quad \text{Eq. 6}$$

The condition in Eq. 6 is inserted it into Eq. 5 to find which axial load is greater.

$\therefore P_m < P_s$

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiments without departing from scope of the Claims.

What is claimed is:

1. A sucker rod string connected to a rotary pump positioned in a well, comprising:

a plurality of sucker rods connected end to end, each sucker rod comprising:

an elongated metal body with opposed ends and threaded couplings and pin shoulders positioned at at least one of the opposed ends; and a thread form on the threaded couplings of the sucker rod defining at least two concurrent helixes, and each of the at least two helixes having a different starting position on a circumference of the threaded coupling, such that, when torque is applied to the sucker rod string to drive the rotary pump, the thread form reduces the risk of damage to the threaded coupling.

2. The sucker rod string of claim 1, wherein the threaded couplings are male threaded couplings.

3. A sucker rod string connected to a rotary pump positioned down a well, the sucker rod string comprising:

a plurality of sucker rods connected end to end, each sucker rod comprising:

an elongated metal body having opposed first and second ends, a leading end of each of the first and the second ends of the sucker rod having a threaded coupling, and a shoulder being located closely adjacent the threaded coupling and separating the threaded coupling from a remainder of the sucker rod, a thread form on the threaded coupling of the sucker rod defines at least two concurrent helixes, and each of the at least two helixes have a different starting position on a circumference of the threaded coupling, such that, when torque is applied to the sucker rod string to drive the rotary pump, the thread form reduces the risk of damage to the threaded coupling.

* * * * *